US005708907A

United States Patent [19]

Masuda et al.

[11] Patent Number: 5,708,907

[45] Date of Patent: Jan. 13, 1998

[54] SERIAL ELECTROPHOTOGRAPHIC APPARATUS HAVING IMPROVED FIXING MEMBER

[75] Inventors: Syuzo Masuda, Saijo; Ryouichi Iwama, Kawasaki, both of Japan

[73] Assignee: Fujitsu Limited, Kawasaki, Japan

[21] Appl. No.: 506,195

[22] Filed: Jul. 24, 1995

[30] Foreign Application Priority Data

Aug. 31, 1994 [JP] Japan ..... 6-207259

[51] Int. Cl.[6] ..... G03G 15/00

[52] U.S. Cl. ..... 399/1; 347/112; 347/156; 399/335

[58] Field of Search ..... 355/200, 271, 355/260, 282; 399/1, 46, 335; 347/3, 102, 112, 156

[56] References Cited

U.S. PATENT DOCUMENTS

| | | | |
|---|---|---|---|
| 4,847,643 | 7/1989 | Ohmori | 346/160 |
| 5,001,515 | 3/1991 | Nomura et al. | 355/200 |
| 5,081,495 | 1/1992 | Bellis | 355/211 |
| 5,083,158 | 1/1992 | Kashima et al. | 355/200 |
| 5,105,221 | 4/1992 | Takahashi et al. | 355/210 |
| 5,132,729 | 7/1992 | Matsushita et al. | 355/203 |
| 5,157,416 | 10/1992 | Kinoshita et al. | 346/108 |
| 5,196,884 | 3/1993 | Sugiyama et al. | 355/200 |
| 5,206,682 | 4/1993 | Yamada et al. | 355/200 |
| 5,260,743 | 11/1993 | Sakamoto | 355/202 |
| 5,291,249 | 3/1994 | Lee | 355/229 |

FOREIGN PATENT DOCUMENTS

| | | |
|---|---|---|
| 61-152463 | 7/1986 | Japan . |
| 61-145649 | 9/1986 | Japan . |

*Primary Examiner*—William J. Royer

*Attorney, Agent, or Firm*—Armstrong, Westerman McLeland & Naughton

[57] ABSTRACT

A carriage is constructed such that a processing part and a fixing part are fitted to a sliding part, wherein a frame on which an exposer and a process motor are mounted is rotatably fitted to the sliding part, and a housing which accommodates the fixing part and the processing part not including the exposer is rotatably and detachably fitted to the frame.

95 Claims, 13 Drawing Sheets

SERIAL ELECTROPHOTOGRAPHIC APPARATUS HAVING IMPROVED FIXING MEMBER

BACKGROUND OF THE INVENTION

1. Field of the Invention

The present invention relates to serial electrophotographic apparatuses, and more particularly to a serial electrophotographic apparatus in which a latent image is formed on a recording drum, and toner is used to print a visible image on recording paper.

A demand for inexpensive and compact electrophotographic apparatuses has resulted in the development of serial electrophotographic printers. In electrophotographic printers, a carriage for carrying a printhead is capable of performing an electrophotographic process. In these electrophotographic printers, recording paper is transported in a direction perpendicular to a direction in which the carriage is translated so that a transferring unit effects an image transfer onto the recording paper. A roller shaped fixing unit disposed ahead of the carriage in the direction of transportation effects fixing. Because of an increasingly complex mechanism resulting from the growing demand for improved printing quality, improvement in the maintainability such as a more efficient exchange of components is required.

2. Description of the Prior Art

FIGS. 1A and 1B show a construction of a conventional serial electrophotographic printer 11, FIG. 1A being a partial top view of the printer, and FIG. 1B being a lateral sectional view of a carriage.

The serial electrophotographic printer 11 shown in FIGS. 1A and 1B is disclosed in Japanese Laid-Open Patent Application No. 61-152463. In the electrophotographic printer 11, a shaft 14 is disposed parallel with rollers 13*a* and 13*b* for transporting recording paper 12. A carriage 15 is driven by a motor (not shown) and guided by the shaft 14 to be movable in a direction perpendicular to a direction in which the recording paper is transported. A fixing unit 16 longer than the width of the recording paper 12 is fixed ahead of the carriage 15 in the direction in which the recording paper is transported. A transferring unit 17 is disposed below the recording paper 12 to lie in the direction in which the carriage 15 is transported.

The carriage 15 carries an image carrying body (recording drum) 21 which is rotated at a peripheral speed synchronized with the movement of the carriage 15. The surface of the image carrying body 21 is uniformly charged by a charger 22 (a charging roller) 22, and an electrostatic latent image is formed by an exposer 23. The electrostatic latent image is made visible to become a toner image by a developing roller 26 which is formed adjacent to the image carrying body 21 and supplies toner 25 stored in a developing unit 24 to the image carrying body 21. Toner image formed on the image carrying body 21 is transferred to the recording paper 12 by the transferring unit 17 disposed opposite to the image carrying body 21, the recording paper 12 being led through a space between the image carrying body 21 and the transferring unit 17. The recording paper 12 is transported so that a part which has undergone a transferring process faces the fixing unit 16, whereupon the image is fixed.

A fixing roller may be provided within the carriage 15 for the purpose of making the apparatus more compact.

FIG. 2 shows a construction of the carriage 15 equipped with a fixing part. The carriage 15 shown in FIG. 2 is disclosed in the Japanese Laid-Open Utility Model Application No. 61-145649. The carriage 15 shown in FIG. 2 is constructed such that a fixing part 27 is provided therein. A cleaner 30 scrapes the residual toner off the image carrying body 21 when the printing operation is completed.

The fixing part 27 is provided with a fixing roller 28 rotated in a same direction as the image carrying body 21. A heat source 29 such as a halogen lamp is provided as heating means in the fixing roller 28. The fixing roller 28 is preheated to a predetermined temperature by the heat source 29 before the printing operation. The temperature of the fixing roller 28 during the printing operation is detected by a temperature detecting unit (not shown) such as a thermistor and subjected to control. That is, the fixing part 27 is translated together with the image carrying body 21. The fixing of an image is performed immediately after the transferring operation.

The serial electrophotographic printer 11 described above is characterized by a more frequent printing operations than a line printer. The image carrying body 21, the charging roller 22 and the developing roller 26 undergo a substantial degree of wear per a sheet of recording paper, the load imposed on these components being about ten times that of the line printer. These expendable components, which need exchanging, are so closely interrelated that it is difficult to exchange a desired component. Thus, the maintainability of the conventional printer is poor.

It is also to be noted that the density of the components inside the carriage 15 is great such that the heat generated by the exposer 23, the process motor (not shown) and the fixing part 27 causes unfavorable effect on the printing process. For example, when the temperature in the carriage 15 rises to 80°–100° C. due to the heat generated by the exposer, the process motor and the fixing part, it is likely that a degradation in an image occurs or the life of the rollers and the image carrying body 21 is reduced. For example, the surface temperature of the image carrying body 21 should be controlled below 50°–60° C. Otherwise, the image degradation or the reduction in life occurs.

SUMMARY OF THE INVENTION

Accordingly, it is an object of the present invention to provide a novel and useful serial electrophotographic apparatus in which the aforementioned problems are eliminated.

It is another object of the present invention to provide a serial electrophotographic apparatus in which the maintainability including the ease of exchanging operations is improved, and the heat radiating capability is improved.

In order to achieve the above objects, the present invention provides a serial electrophotographic apparatus comprising: transporting means for transporting recording paper; process driving means for rotating an image carrying body which has a rotation shaft parallel with a direction in which the recording paper is transported, the process driving means being fitted to a carriage; processing means which develops a latent image using a charger and an exposer, the exposer being rotatably fitted to the carriage, and the processing means not including the exposer being rotatably and detachably fitted to the carriage; transferring means which, placed beneath the recording paper, transfers a developed image to the recording paper as the carriage moves; translating means for translating the carriage above the transferring means in a direction perpendicular to the direction in which the recording paper is transported; and fixing means for fixing the image transferred to the recording paper using a heated fixing member.

In one preferred embodiment, the fixing means is rotatably provided within the carriage.

In another preferred embodiment, the fixing means is rotatably and detachably provided within the carriage.

In another preferred embodiment, there is provided a fixing member by which the processing means not including the exposer is detachably coupled to the process driving means and the exposer.

In still another preferred embodiment, the fixing means remains coupled to the process driving means when the process driving means is detached from the processing means not including the exposer, or the fixing means remains coupled to the processing means not including the exposer when the processing means is detached from the process driving means.

According to the serial electrophotographic apparatus of the present invention, a set of components selected from among the exposer, the processing means not including the exposer, the process driving means and the fixing means is arranged to be independent of the non-selected set of the components, and by having the two sets rotatable with respect to each other and detachable from the carriage. In this way, the ease of exchanging operations and the maintainability are improved.

Preferably, the processing means is provided with a positioning part for positioning the exposer so that the processing means and the exposer that are detachable from each other can be properly assembled in respective positions. According to this arrangement, the degradation in image quality is prevented and, at the same time, the maintainability is improved.

In a preferred embodiment, at least one of the process driving means and the exposer is fitted to a heat conductive mounting member.

In another preferred embodiment, the exposer is fitted to the heat conductive mounting member via a heat radiating mounting member.

In still another preferred embodiment, the fixing means is fitted to the heat conductive mounting member or a heat insulating mounting member via a heat conductive member.

In yet another preferred embodiment, the process driving means is provided above the fixing means.

According to these arrangements, it is possible to transfer the heat generated by the process driving means, the exposer and the fixing means to a sliding part and the like of the carriage. Further, the process driving means is heat-insulated from the fixing means, with the result that the heat radiating capability of the carriage is improved.

In another preferred embodiment, a heat radiating member is disposed between the process driving means and the fixing means.

In still another preferred embodiment, a heat insulating member is provided above the fixing means.

According to these arrangements, the processing means is heat-insulated from the fixing means, with the result that the heat radiating capability of the carriage is improved.

In another preferred embodiment, the heating means for heating the fixing means by induction heating is provided adjacent to a position at which the carriage is located at a start of a printing operation.

In yet another preferred embodiment, lifting means for lifting the image carrying body and the fixing means away from the recording paper is provided in a sliding part of the carriage.

DESCRIPTION OF THE PREFERRED DRAWINGS

Other objects and further features of the present invention will be apparent from the following detailed description when read in conjunction with the accompanying drawings, in which.

Figure 5A:
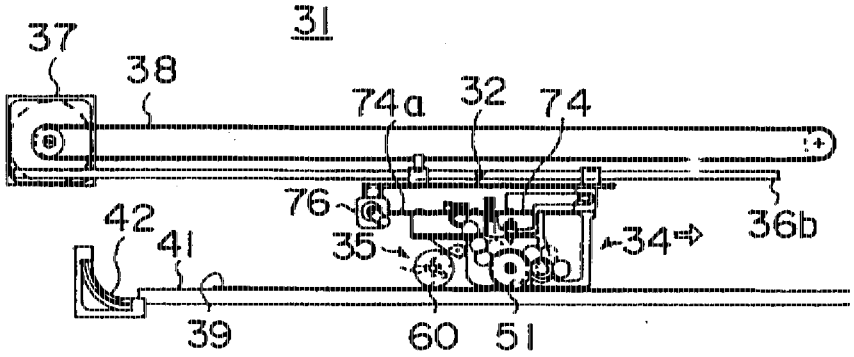
Figure 5B:
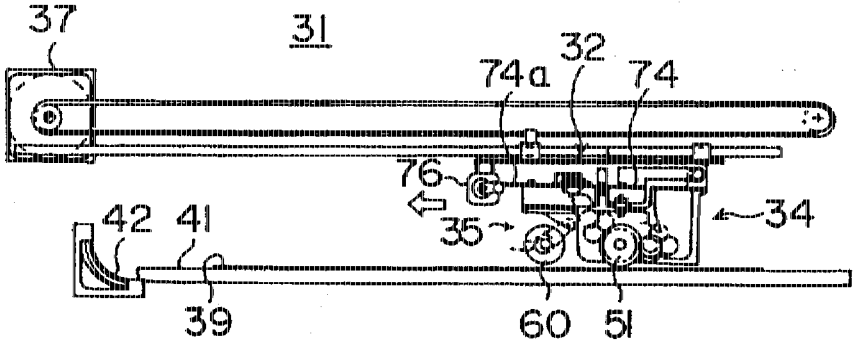
Figure 5C:
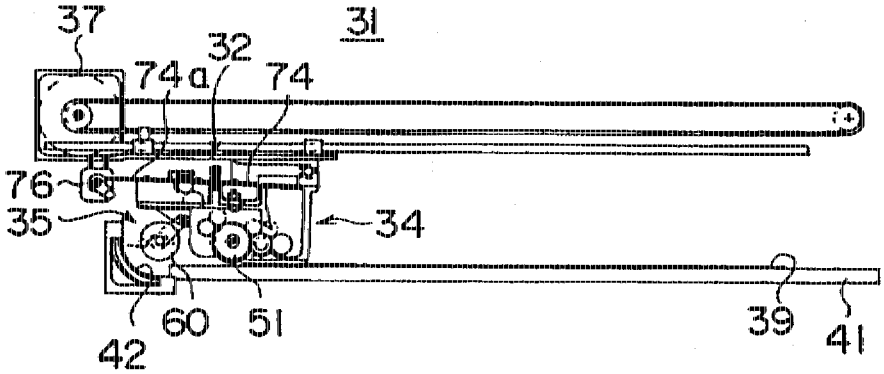
Figure 6A:
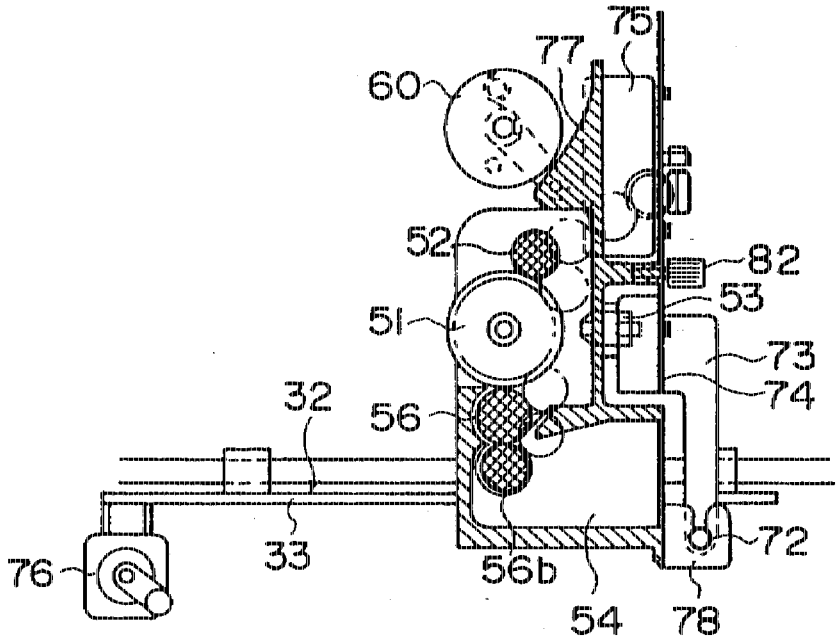
Figure 6B:
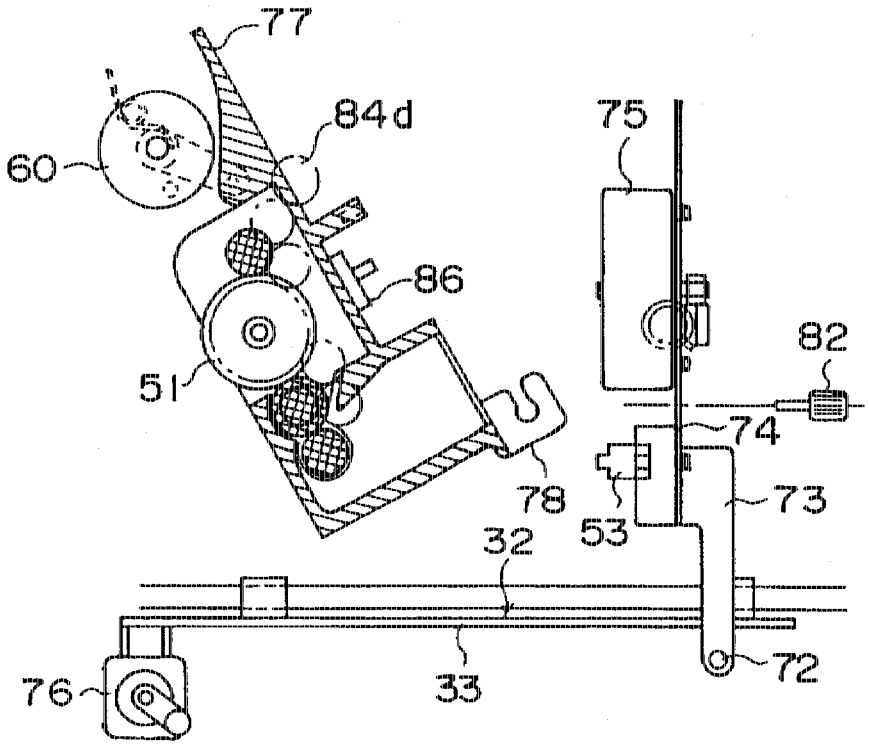
Figure 7A:
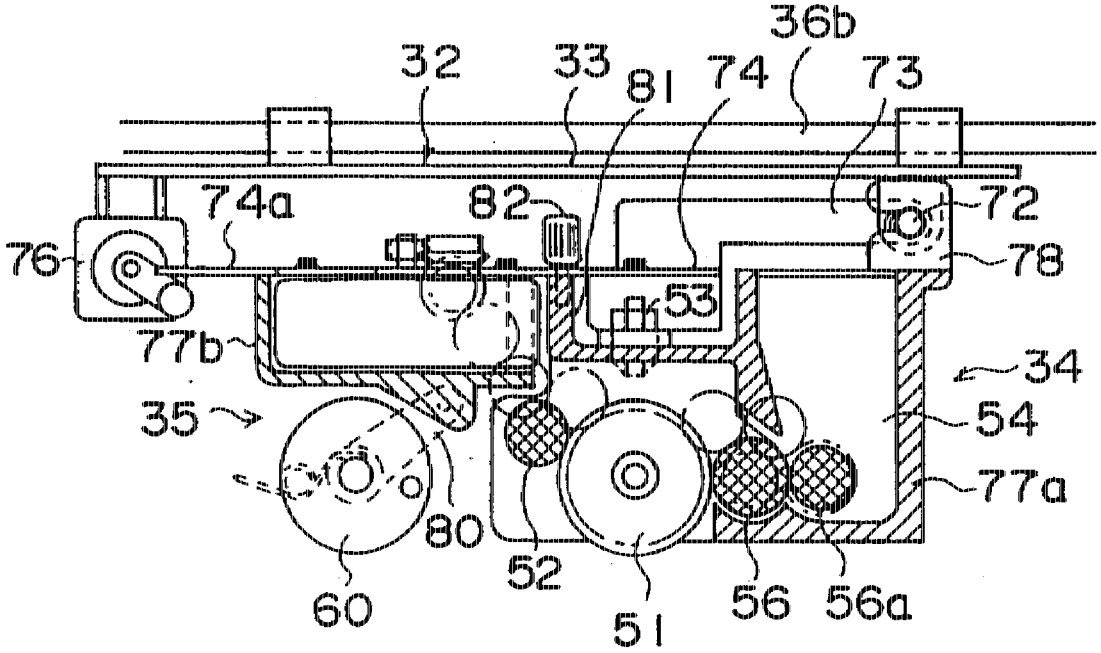
Figure 7B:
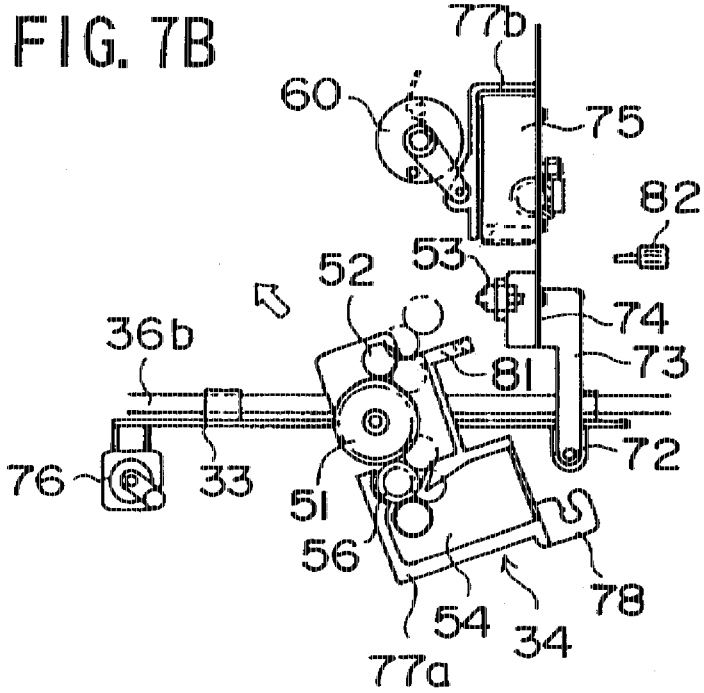
Figure 8A:
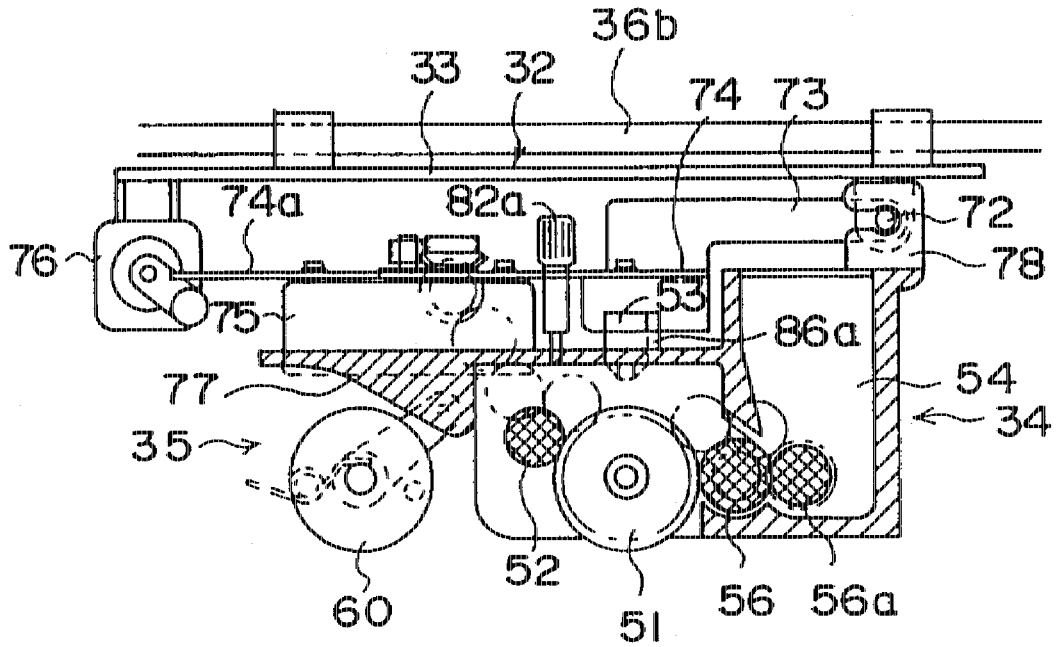
Figure 8B:
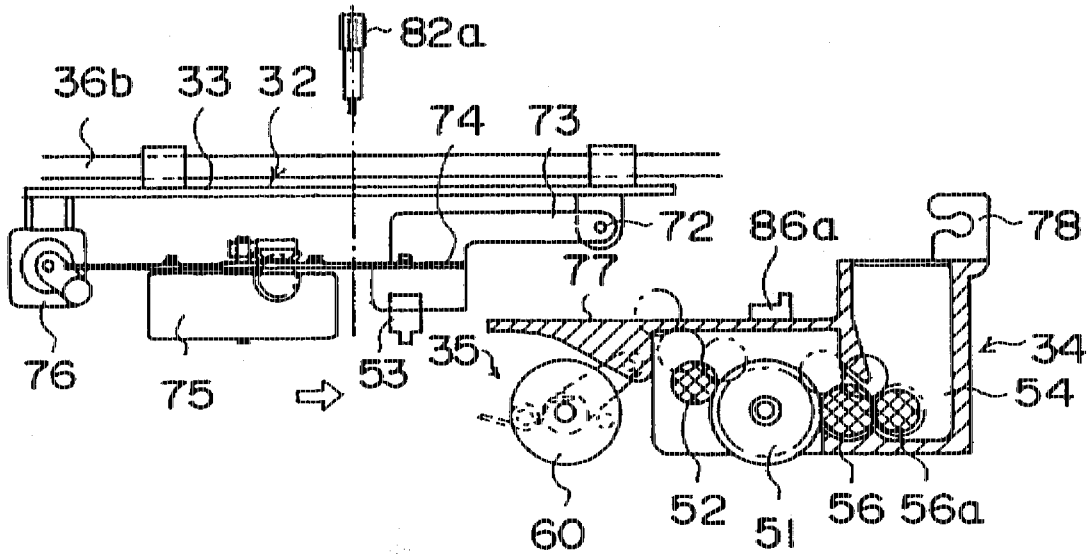
Figure 9A:
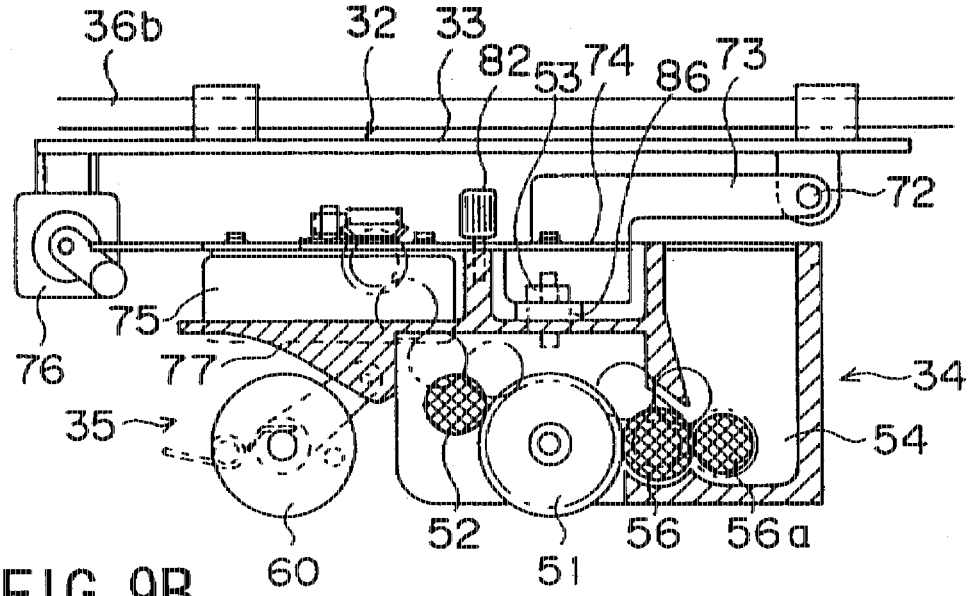
Figure 9B:
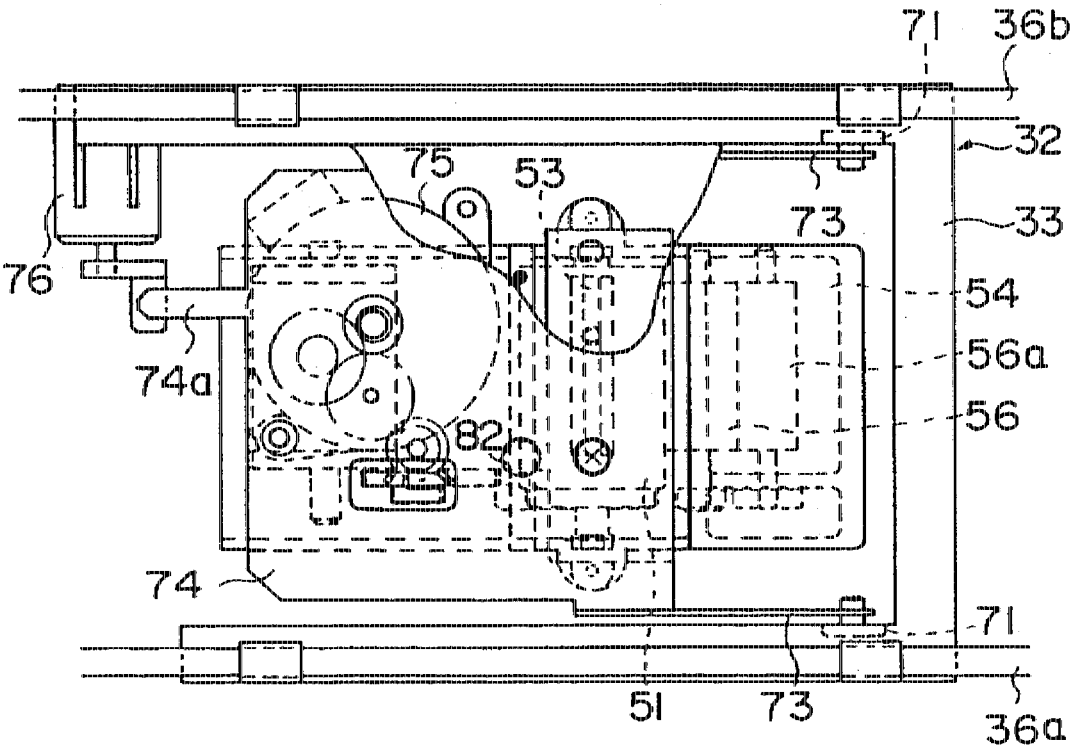
Figure 10A:
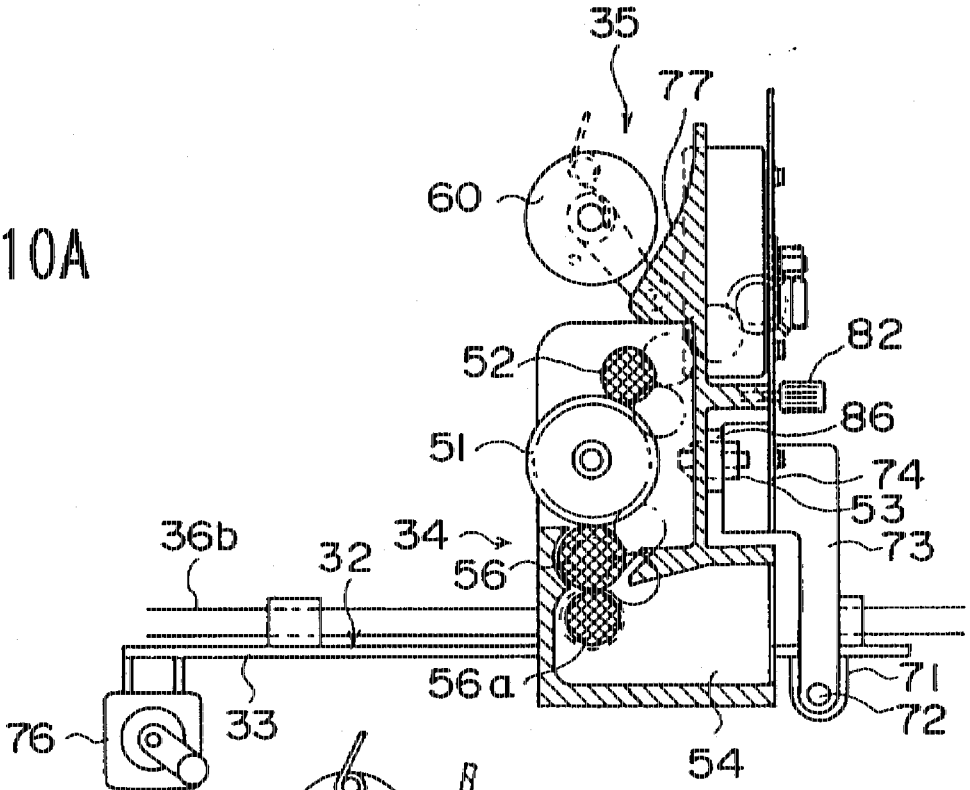
Figure 10B:
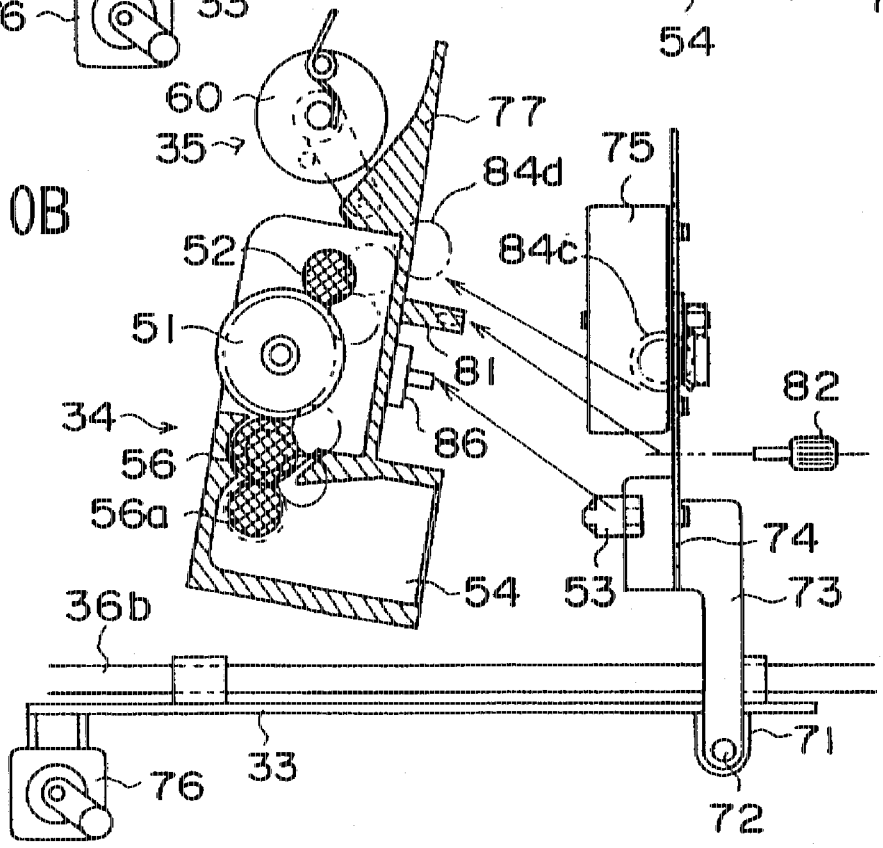
Figure 11A:
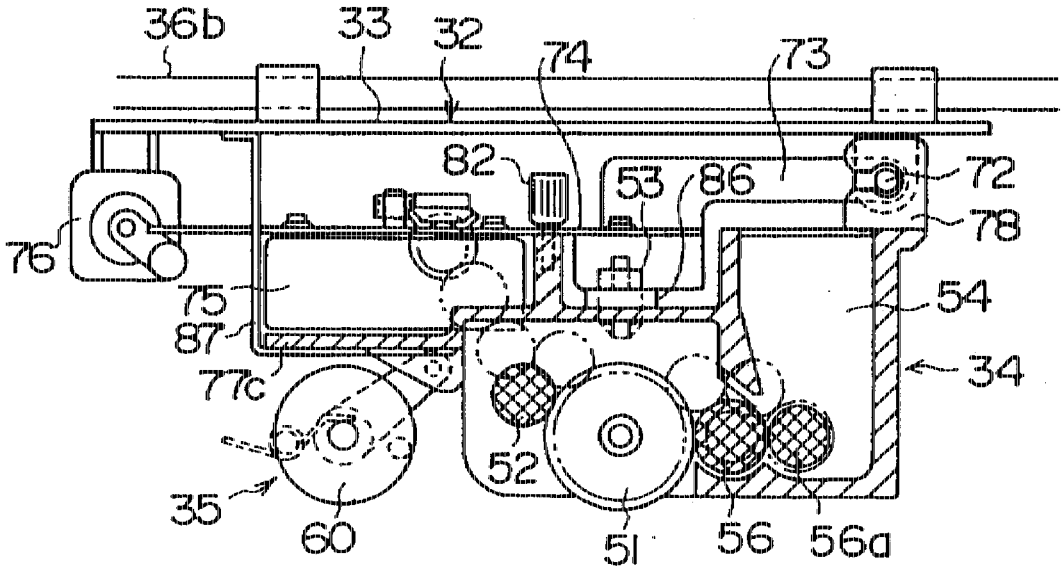
Figure 11B:
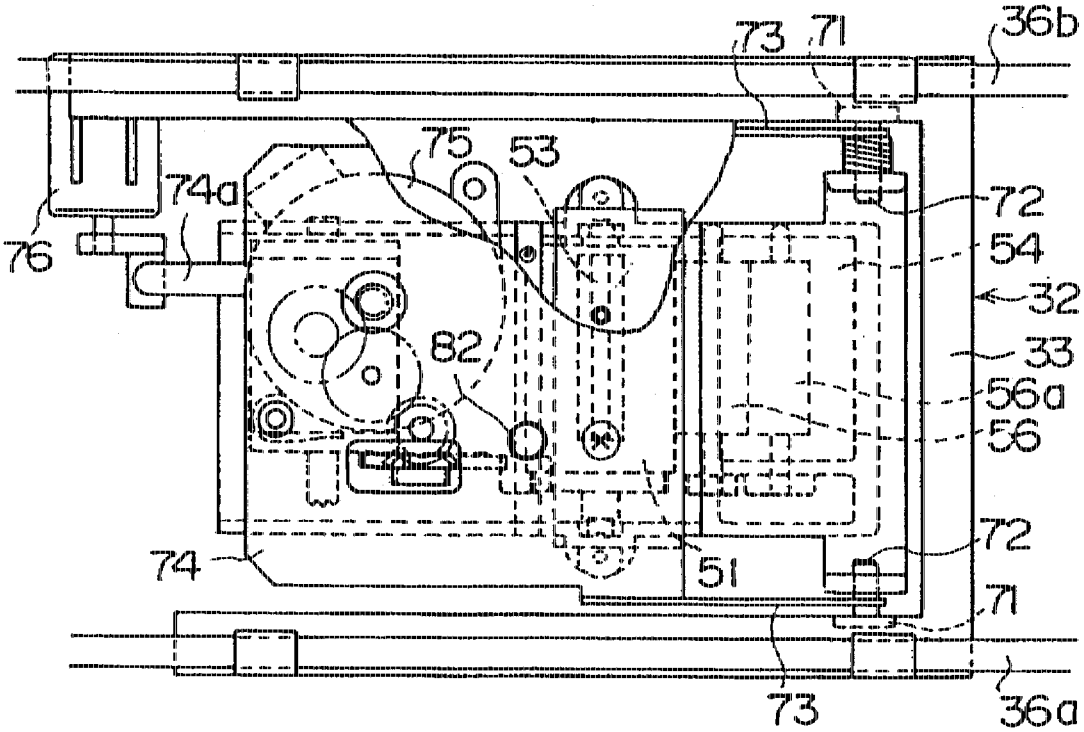
Figure 12A:
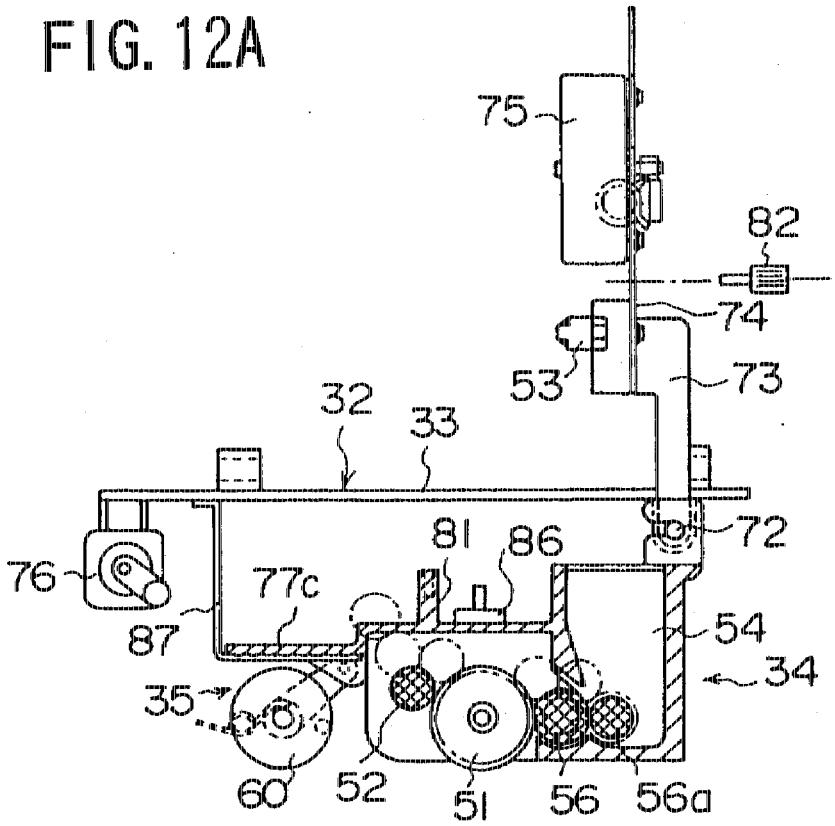
Figure 12B:
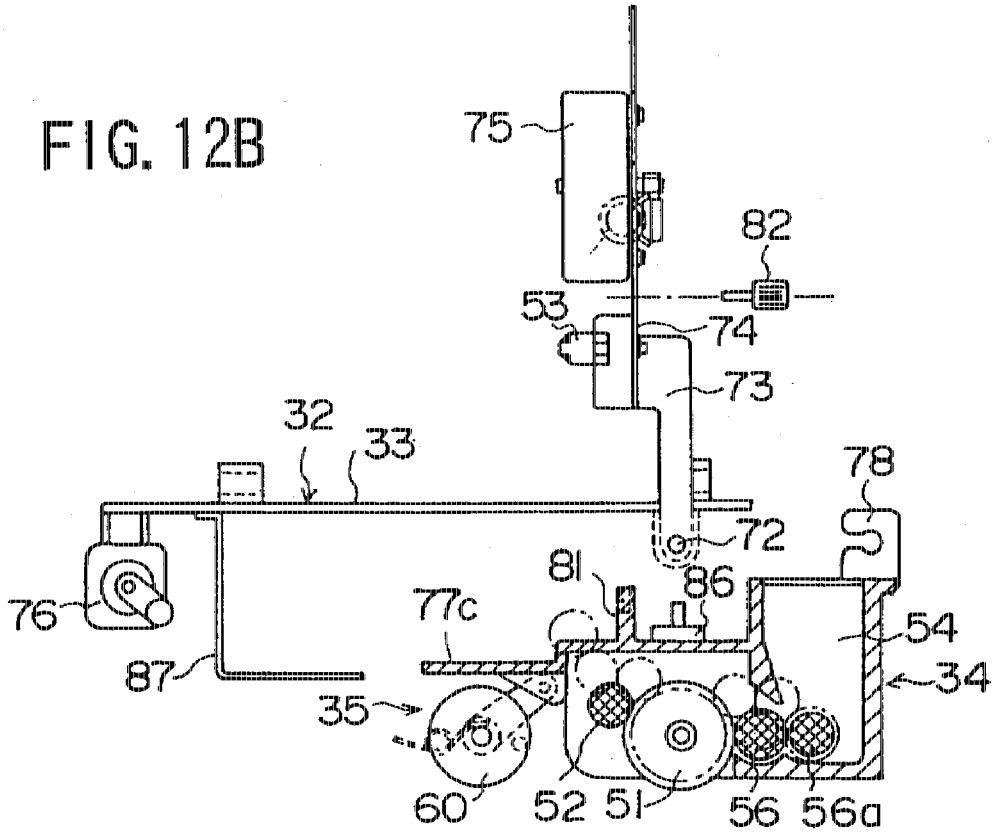
Figure 13:
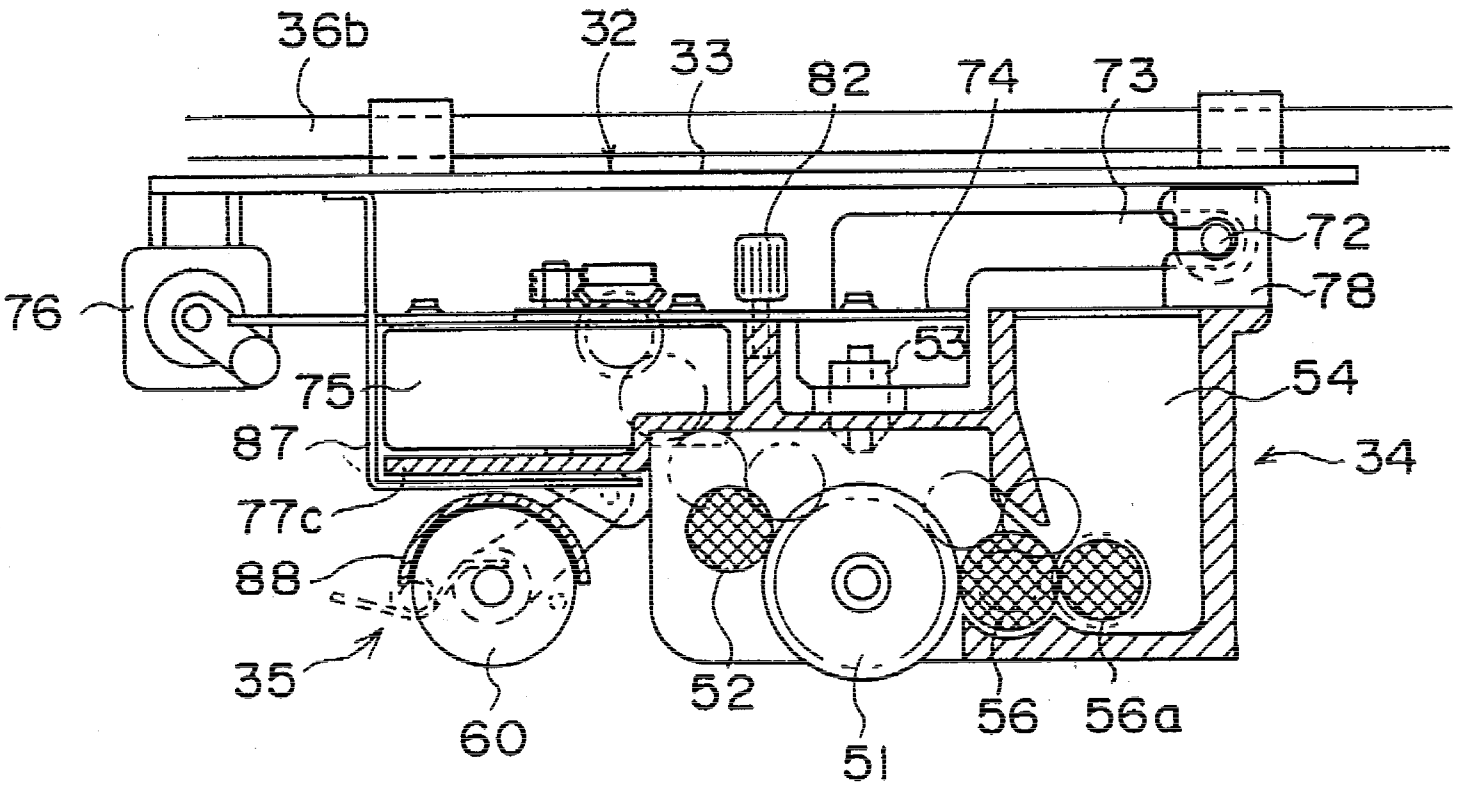

FIGS. 5A–5C explain the movement of the carriage;

FIGS. 6A and 6B explain how a main part of the carriage is exchanged or maintained;

FIGS. 7A and 7B show a construction of a second embodiment of the present invention;

FIGS. 8A and 8B show a construction of a third embodiment of the present invention;

FIGS. 9A and 9B show a construction of a fourth embodiment of the present invention;

FIGS. 10A and 10B show how the main part of the carriage according to the fourth embodiment is exchanged or maintained;

FIGS. 11A and 11B show a construction of a fifth embodiment of the present invention;

FIGS. 12A and 12B show how the main part of the carriage according to the fifth embodiment is exchanged or maintained; and FIG. 13 shows a construction of a sixth embodiment of the present invention.

DESCRIPTION OF THE PREFERRED EMBODIMENTS

Figure 1A:
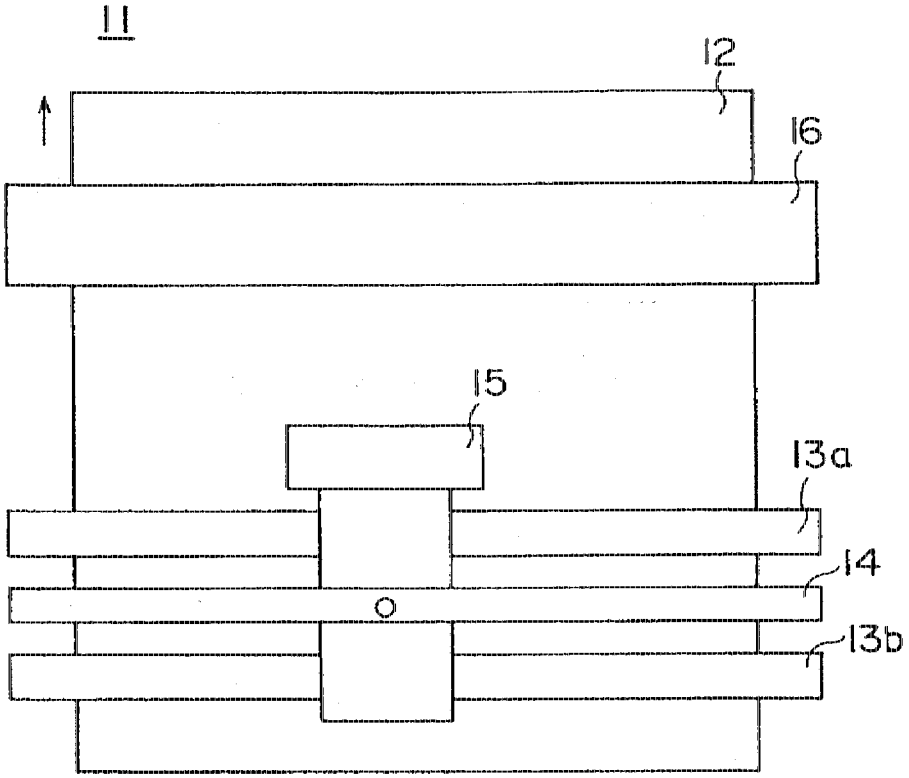
FIG. 1A PRIOR ART
FIG. 1A is a top view showing a construction of a conventional serial electrophotographic printer.
Figure 1B:
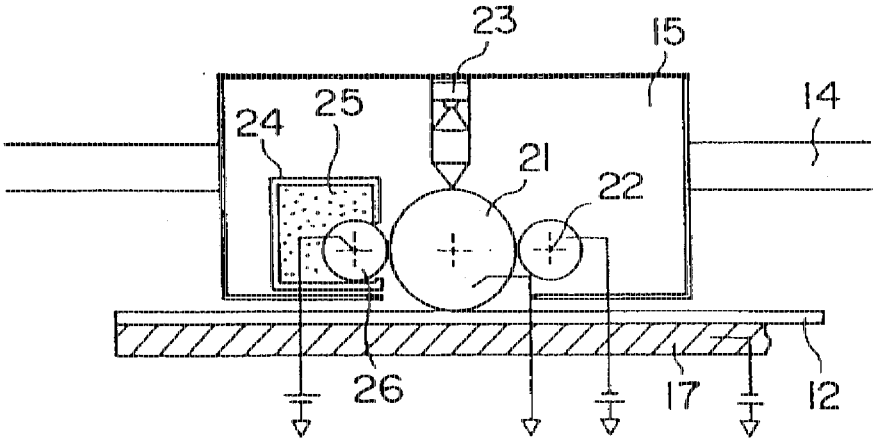
FIG. 1B PRIOR ART
FIG. 1B is a lateral sectional view showing the construction of the conventional serial electrophotographic printer.
Figure 2:
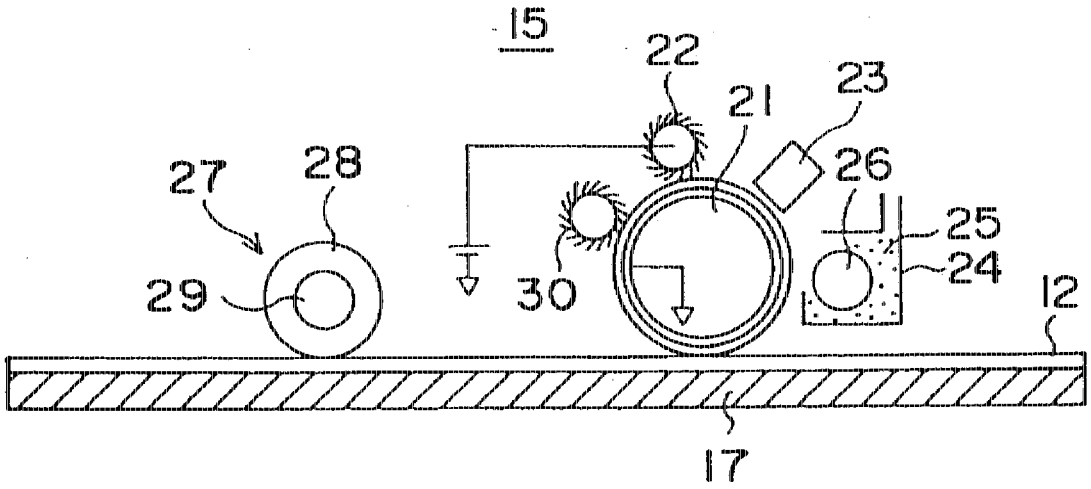
FIG. 2 PRIOR ART
FIG. 2 shows a construction of a carriage equipped with a fixing part.
Figure 3A:
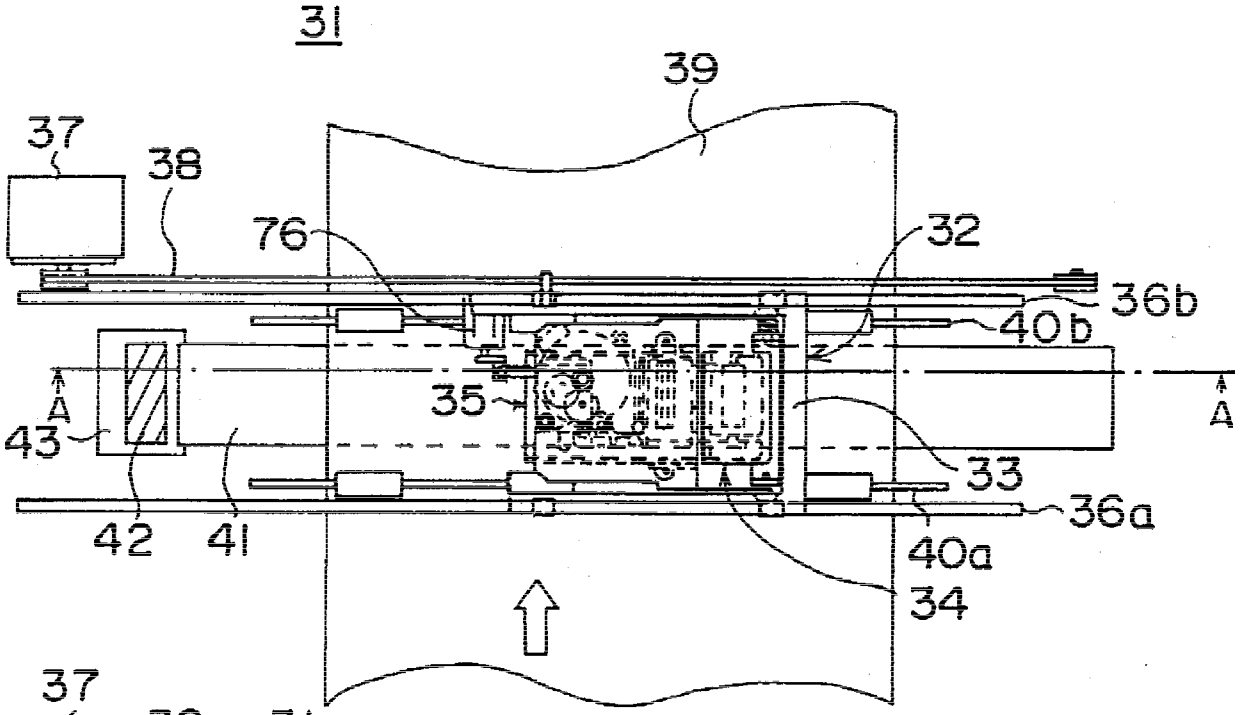
FIG. 3A is a top sectional view showing a construction of a first embodiment of the present invention.
Figure 3B:
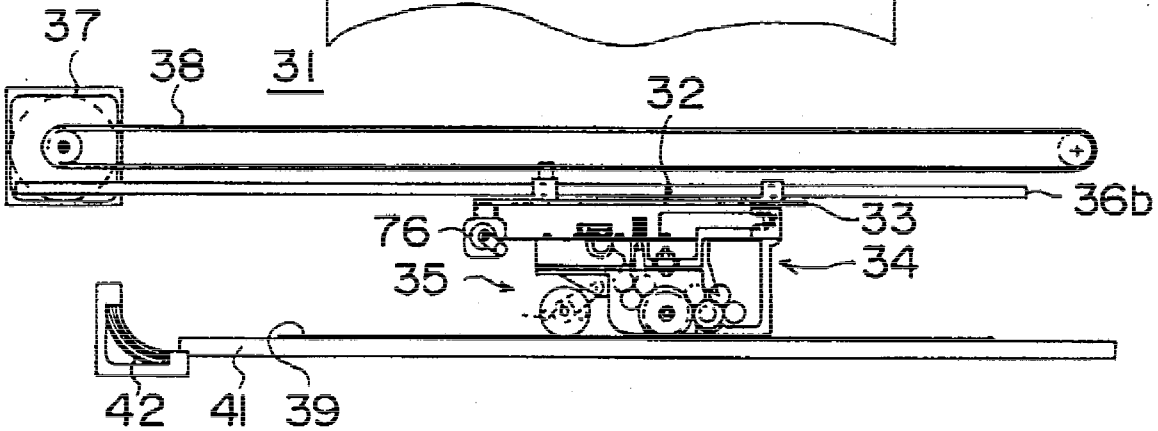
FIG. 3B is a lateral sectional view showing the construction of the first embodiment.
Figure 4A:
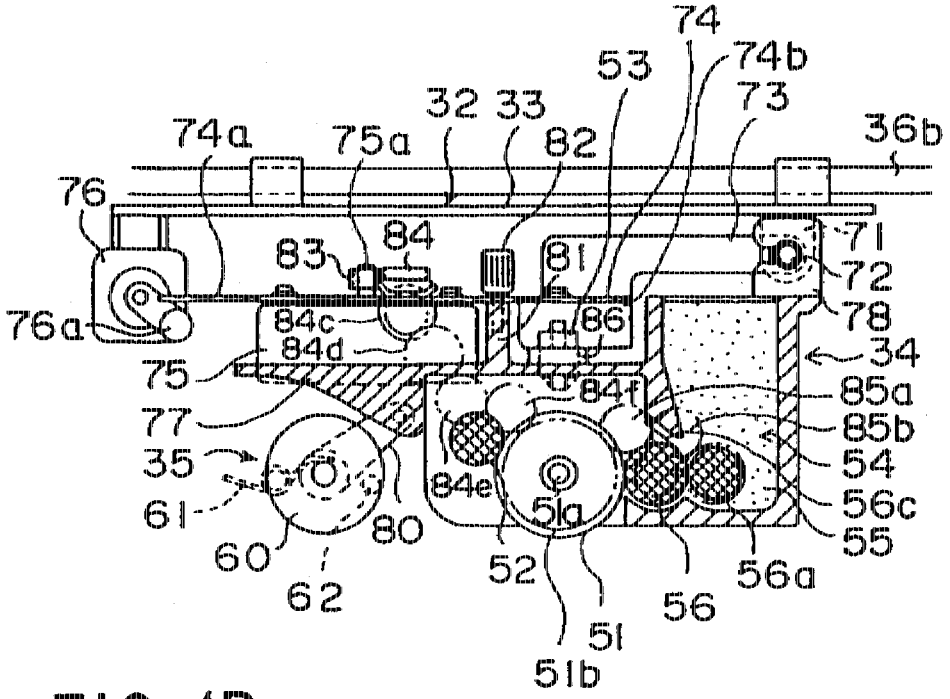
FIG. 4A is an enlarged lateral sectional view showing a carriage.
Figure 4B:
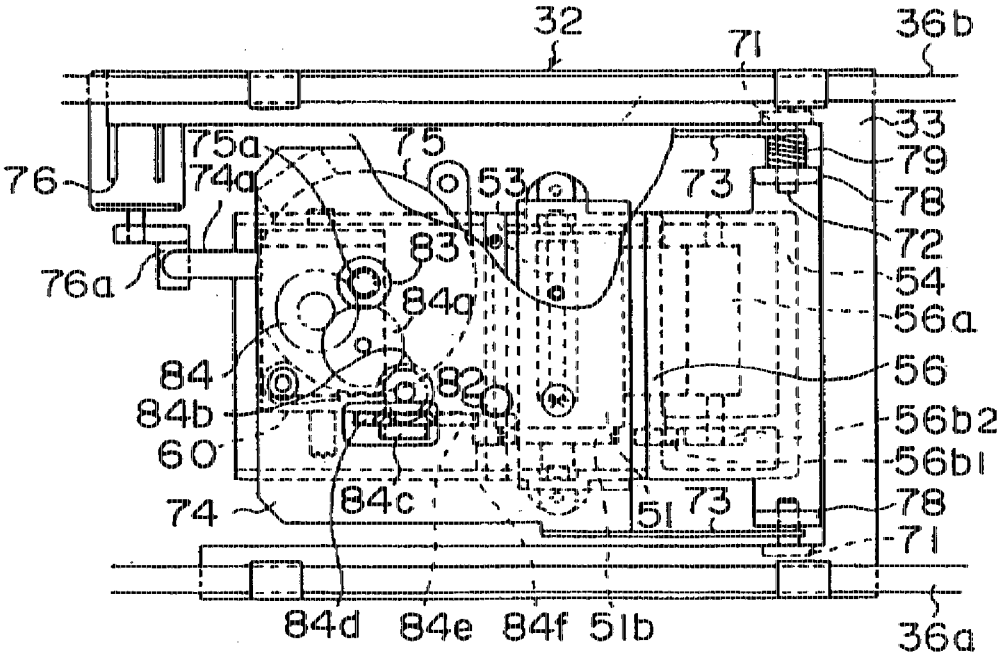
FIG. 4B is a partially sectioned enlarged top view showing the carriage.

FIGS. 3A and 3B show a construction of a first embodiment of the present invention. FIG. 3A is a top view, and FIG. 3B is a lateral sectional view taken along the line A–A of FIG. 3A. FIG. 4A is an enlarged sectional view showing a carriage, and FIG. 4B is an enlarged top sectional view showing the carriage.

FIGS. 3A and 3B show a serial electrophotographic printer 31 as a specific example of an electrophotographic apparatus. A carriage 32 is constructed such that a processing part (processing means) 34 and a fixing part (fixing means) 35 are mounted to a sliding part 33.

The sliding part 33 is guided by guide shafts **36*a* and 36*b* and driven by a carrier motor (translating means) 37 via a belt 38 so as to move in a direction perpendicular to a direction in which recording paper 39 is transported. The recording paper 39 is transported in a direction indicated by an arrow by means of rotating shafts (transporting means) 40*a* and 40*b*** (a driving motor for driving the rotating shafts is omitted from the illustration).

A transferring unit 41 which constitutes transferring means in the claims is disposed beneath the carriage 32 so as to lie in the direction in which the carriage 32 is translated. The transferring unit 41 is a platen produced such that a heat-resistant conductive member (for example, a silicone rubber having conductive material mixed therein) is formed on a substrate made, for example, of an aluminum, so as to face the carriage 32. The recording paper 39 is transported through a space between the transferring unit 41 and the carriage 32.

An induction coil 42 (heating means) is provided in a holder 43 so as to be adjacent to a fixing roller 60 of the fixing part 35 when the carriage 32 is located at an initial position (home position) at which the printing is started. The induction coil 42 is curved into an arc shape so as to match the outline of the fixing roller 60. The induction coil 42 effects the induction heating in the fixing roller 60 by applying thereto the magnetic flux generated by a current in the induction coil 42.

As shown in FIGS. 4A and 4B, the processing part 34 of the carriage 32 has a recording drum (image carrying body) 51 built therein, the drum 51 having a rotation axis 51a extending parallel to the direction in which the recording paper 39 is transported and being rotated on the recording paper 39 lying on the transferring unit 41 at a peripheral speed synchronized with the translation of the carriage 32.

The surface of the recording drum 51 is uniformly charged by a charger 52, and has an electrostatic image formed on its surface by an exposer 53 disposed above the recording drum 51. The electrostatic latent image is turned into an toner image (visible image) by toner 55 being applied by a developing roller 56 to the recording drum 51, the toner 55 being stored in a developing unit 54. The toner image formed on the recording drum 51 is transferred to the recording paper 39 by applying a predetermined voltage between the recording drum 51 and the transferring unit 41 that sandwich the recording paper 39. The developing roller 56 is made to rotate in synchronism with the rotation of the recording drum 51.

The developing unit 54 is equipped with a supplying roller **56*a* which is in contact with the developing roller 56** so as to supply toner thereto.

The fixing part 35 mounted to the carriage 32 together with the processing part 34 is equipped with a fixing roller 60. The fixing roller 60 is formed of a magnetic material such as an iron and has a protective material coated on its surface. A thermistor (not shown) is provided in the fixing roller 60 as a temperature detector and used to maintain the fixing roller 60 at a predetermined temperature. The fixing roller 60 is urged toward the recording paper 39 by a torsion spring 61 with a predetermined pressure. A stopper 62 for restraining the movement of the fixing roller 60 when the fixing roller 60 is lifted to a safety zone is formed in the fixing roller 60.

A description will now be given of a structural configuration of the serial electrophotographic printer 31. As shown in FIGS. 4A and 4B, one end of the sliding part 33 is provided with a hanger part 71. A supporting plate 73 is coupled to the hanger part 71 so as to be rotatable around a connecting pin 72. The supporting plate 73 is provided at both sides of the carriage 32. The supporting plate 73 and a frame 74 which is integral therewith constitute a heat conductive mounting member in the claims. The exposer 53 is fitted to the frame 74 via a radiator plate **74*b* which is a heat radiating mounting member in the claims. Further, a process motor 75 (process driving means in the claims) is fitted to the frame 74**.

The frame 74 is formed of a highly heat conductive material such as an aluminum and serves as a heat radiator both for the exposer 53 and the process motor 75. The frame 74 also conducts the heat to the sliding part 33. By forming the connecting pin 72 of a highly heat conductive material such as a brass and by forming the sliding part 33 of a highly heat conductive material such as an aluminum, the heat conducted to the sliding part 33 is successfully transferred to the guide shafts **36*a* and 36*b* and radiated therefrom. The frame 74 also serves as a screen for keeping the processing part 34 and the process motor 75** out of view.

A projection **74*a* formed in the frame 74 functions to lift the carriage 32 to a safety zone when the projection 74*a* is engaged with a rotating engagement part 76*a* of the lifting motor (lifting means) 76**.

The recording drum 51, the charger 52, the developing unit 54 and the fixing part 35 are disposed in a housing 77 (indicated by a shaded area in FIG. 4A). A detachable part 78 having an open end is coupled to the connecting pin 72 so as to be rotatable and detachable. A spring 79 is interposed between the housing 77 and one of the supporting plate 73. The fixing roller 60 is mounted to the housing 77 via a rotatable plate 80.

A mounting part 81 which is in contact with the frame 74 is formed in the housing 77. The mounting part 81 is detachably fitted to the frame 74 by means of a thumb screw (fixing member) 82.

A gear 83 is provided in a rotation shaft **75*a* of the process motor 75. A bevel gear 84 is in meshing engagement with the gear 84. A rotational force is transmitted from the bevel gear 83 to a drum gear 51*b* of the recording drum 51 via gears 84*a*–84*f***.

The rotational force is transmitted from the drum gear **51*b* to rotational gears $56b_1$ and $56b_2$ of the developing roller 56 and the supplying roller 56*a* via gears 85*a* and 85*b* (not shown in FIG. 4B**).

A positioning part 86 for positioning the exposer 53 with respect to the recording drum 51 by being interlocked with the exposer 53 is formed in the housing 77 at a position opposite to the exposer 53. When this positioning operation is carried out, the gear **84*c* is disconnected from the gear 84*d***.

In the developing unit 54, the end of a blade **56*c* provided in the housing 77 comes into contact with the developing roller 56 so as to adjust the thickness of the toner 55 attached to the developing roller 56**.

FIGS. 5A–5C explain the movement of the carriage of FIGS. 3A and 3B. Referring to FIG. 5A, while the carriage 32 is being translated by the carrier motor 37 in a direction in which the printing is done, that is, in the direction perpendicular to the direction in which the recording paper 39 is transported, an image is transferred to the recording paper 39 by means of the recording drum 51 and the transferring unit 41. Subsequently, the fixing roller 60 fixes the image.

Referring to FIG. 4B, when the carriage 32 has reached a position at the end of the printing of a line on the recording paper 39, the lifting motor 76 is driven so as to lift the frame 74 using the projection **74*a*. This lifting motion causes the recording drum 51 and the fixing roller 60 away from the recording paper 39 so that the recording drum 51 and the fixing roller 60 resides at a safety zone. The carriage 32** is moved in a direction indicated by an arrow so as to return to the home position.

Referring to FIG. **4*c*, when the carriage 32 has returned to the home position, the fixing roller 60 becomes adjacent to the induction coil 42. The induction heating effected by the induction coil 42 heats the fixing roller 60** to a predetermined temperature.

FIGS. 6A and 6B show how a main part of the carriage of the first embodiment is exchanged or maintained. Expendable components that need exchanging due to repeated printing operations by the carriage 32 include the recording drum 51, the charger 52, the developing unit 54 (developing roller 56, supplying roller 56*a*) and the fixing roller 60. Components that need cleaning and maintenance include the exposer 53 and the process motor 75.

As shown in FIG. 6A, when the exchanging or maintenance is required, the frame 74 and the housing 77 are rotated around the connecting pin 72. As shown in FIG. 6B, the removing of the thumb screw 82 disengage the connecting pin 72 from the detachable part 78 through the open end of the detachable part 78. Consequently, those components other than the exposer 53 and the process motor 75 are detached from the carriage 32.

Thus, it is easy to exchange or maintain the fixing part 35 or the processing part 34 not including the exposer 53. In addition, it is easy to clean the exposer 53 and maintain the process motor 75. Accordingly, the maintainability of the electrophotographic printer 31 is improved.

It is to be noted that by forming the frame 74, the connecting pin 72 and the sliding part 33 of a highly heat conductive material, the heat generated by the exposer 53 and the process motor 75 can be successfully transferred to the guide shafts 36*a* and 36*b* so as to improve the heat radiation capability.

FIGS. 7A and 7B show a construction of a second embodiment of the present invention. FIG. 7A is a lateral sectional view of the carriage, and FIG. 7B is a side view of the carriage and explains how the main part of the carriage can be exchanged or maintained.

The carriage 32 shown in FIG. 7A differs from the carriage 32 of the first embodiment in that a fixing part housing 77*b* formed of a highly heat conductive material and a processing part housing 77*a* are provided instead of the housing 77 of the first embodiment. The fixing part housing 77*b* is integral with or secured to the frame 74. The remaining aspects of the construction are the same as those of the carriage 32 of the first embodiment.

The fixing roller 60 is mounted to the fixing part housing 77*b* via the rotatable plate 80. The mounting part 81 is provided in the processing part housing 77*a*.

As shown in FIG. 7*b*, the frame 74 and the processing part housing 77*a* are rotated around the connecting pin 72 when the exchanging or maintenance is required. By removing the thumb screw 82, the processing part housing 77*a* is detached from the carriage 32. In this way, the exchanging or maintenance in the processing part 54 not including the exposer 53 is enabled. The exchanging or maintenance of the fixing roller 60 is performed while the fixing roller 60 remains mounted to the frame 74.

With the above-described construction, the maintainability of the carriage 32 is improved.The fixing part housing 77*b* ensures an improved heat radiation efficiency by transferring the heat generated in the fixing roller 60 to the frame 74.

FIGS. 8A and 8B show a construction of a third embodiment of the present invention. FIG. 8A is a lateral sectional view of the carriage, and FIG. 8B explains how the main part is exchanged or maintained.

The carriage 32 shown in FIG. 8A is constructed such that a positioning part 86*a* is formed in the housing 77 to project therefrom. The positioning part 86*a* properly positions the exposer 53 mounted to the frame 74 by butting against the exposer 53 horizontally.

In the third embodiment, the mounting part 81 of the first embodiment is omitted. A thumb screw 82*a* is directly screw coupled to the housing 77 so as to secure the housing 77 to the frame 74. The other aspects of the construction are the same as those of the first embodiment.

As shown in FIG. 8B, the housing 77 can be detached form the carriage 32 by removing the thumb screw 82*a* and sliding the housing 77 in a direction indicated by an arrow. According to this construction, the maintainability of the electrophotographic printer 31 is improved.

FIGS. 9A and 9B show a construction of a fourth embodiment of the present invention. FIG. 9A is a lateral sectional view of the carriage, and FIG. 9B is a partially sectioned top view of the carriage.

The carriage 32 shown in FIGS. 9A and 9B is constructed such that the detachable part 78 formed in the housing 77 of the first embodiment is omitted. The other aspects of the construction are the same as those of the first embodiment.

FIGS. 10A and 10B explain how the main part of the carriage of the fourth embodiment is exchanged or maintained. When the exchanging or maintenance is required, the frame 74 and the housing 77 are rotated around the connecting pin 72, as shown in FIG. 10A.

As shown in FIG. 10B, the housing 77 is detached from the carriage 32 by removing the thumb screw 82. In this way, the fixing part 35 and the processing part 34 not including the exposer 35 can be exchanged or maintained. In this state, the exposer 35 may be cleaned or the process motor 75 is maintained.

As described above, the exchanging or maintenance of relevant components is easy because the housing 77 can be detached from the carriage 32 by removing the thumb screw 82. Thus, the fourth embodiment improves the maintainability of the electrophotographic printer 31.

FIGS. 11A and 11B show a construction of a fifth embodiment of the present invention. FIG. 11A is a lateral sectional view of the carriage, and FIG. 11B is a partially sectioned top view of the carriage.

The carriage 32 shown in FIGS. 11A and 11B is constructed such that a housing 77*c* is formed of a heat insulating material such as a polycarbonate (PC), and a radiator part 87 is provided to extend from the sliding part 33. The radiator part 87 is disposed between the housing 77*c* and the fixing roller 60. The other aspects of the construction are the same as those of the first embodiment.

The radiator part 87 is formed, for example, of an aluminum. The radiator part 87 blocks the heat flow as well as the heat radiated by the fixing roller 60 so as to prevent the temperature of the housing 77*c* to increase due to the fixing roller 60 being heated. Since the radiator part 87 is fitted to the sliding part 33, the radiator part 87 functions such that the heat is efficiently diffused into the guide shafts 36*a* and 36*b*.

The translation of the carriage 32 ensures that the radiator part 87 is cooled and its temperature is prevented from rising. Further, the magnetic shield effect of the radiator part 87 prevents the temperature of the process motor 75 from rising due to the leakage flux of the induction coil 42 (see FIGS. 3A and 3B). In this way, it is expected that the process motor 75 has a long life.

FIGS. 12A and 12B show how the main part of the carriage according to the fifth embodiment is exchanged or maintained. As shown in FIG. 12A, the frame 74 is allowed to rotate around the connecting pin 72 by removing the thumb screw 82. The housing 77*c* is remains mounted to the carriage 32 by the connecting pin 72 and the radiator part 87.

As shown in FIG. 12B, the housing 77*c* can be removed by sliding it along the open end of the mounting part 78.

In this way, the exchanging and maintenance of the fixing part 35 and the processing part 34 not including the exposer 53 can be performed easily. In addition, the cleaning of the exposer 53 and the maintenance of the process motor 75 can be performed easily. In this way, the maintainability of the electrophotographic printer 31 is improved.

FIG. 13 shows a construction of a sixth embodiment of the present invention. FIG. 13 is a lateral sectional view of the carriage 32 according to the sixth embodiment. Referring to FIG. 13, an arc-shaped heat insulator part 88 formed, for example, of a PC is provided above the fixing roller 60. The other aspects of the construction are equal to those of the fifth embodiment.

According to the sixth embodiment, the housing 77*c*, the radiator part 87 and the heat insulator part 88 are provided below the process motor 75. In this way, the heat of the fixing roller 60 is prevented from being transferred to the process motor 75 so that the a long life of the process motor 75 is ensured.

The radiator part 87 may be provided between the process motor 75 and the housing 77*c*. In this case, the housing 77*c* can be removed by rotating the frame 74 and removing the thumb screw 82 as described in the first embodiment.

The present invention is not limited to the above described embodiments, and variations and modifications may be made without departing from the scope of the present invention.

What is claimed is:

1. A serial electrophotographic apparatus comprising:

transporting means for transporting recording paper;

process driving means for rotating an image carrying body which has a rotation shaft parallel with a direction in which the recording paper is transported, said process driving means being fitted to a carriage;

processing means which develops a latent image using a charger and an exposer, said exposer being rotatably fitted to the carriage, and said processing means not including the exposer being rotatably and detachably fitted to the carriage;

transferring means which, placed beneath the recording paper, transfers a developed image to the recording paper as the carriage moves;

translating means for translating said carriage above said transferring means in a direction perpendicular to the direction in which the recording paper is transported; and fixing means for fixing the image transferred to the recording paper using a heated fixing member;

wherein said fixing means is rotatably provided within said carriage.

2. The serial electrophotographic apparatus as claimed in claim 1, wherein there is provided a fixing member by which said processing means not including the exposer is detachably coupled to said process driving means and said exposer.

3. The serial electrophotographic apparatus as claimed in claim 2, wherein said fixing means remains coupled to said process driving means when said process driving means is detached from the processing means not including the exposer, or said fixing means remains coupled to said processing means not including the exposer when said processing means is detached from the process driving means.

4. The serial electrophotographic apparatus as claimed in claim 2, wherein said processing means is provided with a positioning part for positioning said exposer.

5. The serial electrophotographic apparatus as claimed in claim 2, wherein said process driving means is provided above said fixing means.

6. The serial electrophotographic apparatus as claimed in claim 5, wherein a heat radiating member is disposed between said process driving means and said fixing means.

7. The serial electrophotographic apparatus as claimed in claim 6, wherein a heat insulating member is provided above said fixing means.

8. The serial electrophotographic apparatus as claimed in claim 7, wherein heating means for heating said fixing means by induction heating is provided adjacent to a position at which the carriage is located at a start of a printing operation.

9. The serial electrophotographic apparatus as claimed in claim 6, wherein heating means for heating said fixing means by induction heating is provided adjacent to a position at which the carriage is located at a start of a printing operation.

10. The serial electrophotographic apparatus as claimed in claim 5, wherein a heat insulating member is provided above said fixing means.

11. The serial electrophotographic apparatus as claimed in claim 10, wherein heating means for heating said fixing means by induction heating is provided adjacent to a position at which the carriage is located at a start of a printing operation.

12. The serial electrophotographic apparatus as claimed in claim 1, wherein at least one of said process driving means and said exposer is fitted to a heat conductive mounting member.

13. The serial electrophotographic apparatus as, claimed in claim 12, wherein said exposer is fitted to said heat conductive mounting member via a heat radiating mounting member.

14. The serial electrophotographic apparatus as claimed in claim 12, wherein said fixing means is fitted to said heat conductive mounting member or a heat insulating mounting member via a heat conductive member.

15. The serial electrophotographic apparatus as claimed in claim 14, wherein said process driving means is provided above said fixing means.

16. The serial electrophotographic apparatus as claimed in claim 15, wherein a heat radiating member is disposed between said process driving means and said fixing means.

17. The serial electrophotographic apparatus as claimed in claim 16, wherein a heat insulating member is provided above said fixing means.

18. The serial electrophotographic apparatus as claimed in claim 17, wherein heating means for heating said fixing means by induction heating is provided adjacent to a position at which the carriage is located at a start of a printing operation.

19. The serial electrophotographic apparatus as claimed in claim 16, wherein heating means for heating said fixing means by induction heating is provided adjacent to a position at which the carriage is located at a start of a printing operation.

20. The serial electrophotographic apparatus as claimed in claim 15, wherein a heat insulating member is provided above said fixing means.

21. The serial electrophotographic apparatus as claimed in claim 20, wherein heating means for heating said fixing means by induction heating is provided adjacent to a position at which the carriage is located at a start of a printing operation.

22. The serial electrophotographic apparatus as claimed in claim 14, wherein a heat radiating member is disposed between said process driving means and said fixing means.

23. The serial electrophotographic apparatus as claimed in claim 22, wherein a heat insulating member is provided above said fixing means.

24. The serial electrophotographic apparatus as claimed in claim 23, wherein heating means for heating said fixing means by induction heating is provided adjacent to a position at which the carriage is located at a start of a printing operation.

25. The serial electrophotographic apparatus as claimed in claim 22, wherein heating means for heating said fixing means by induction heating is provided adjacent to a position at which the carriage is located at a start of a printing operation.

26. The serial electrophotographic apparatus as claimed in claim 1, wherein said fixing means is fitted to a heat conductive mounting member or a heat insulating mounting member via a heat conductive member.

27. The serial electrophotographic apparatus as claimed in claim 26, wherein said process driving means is provided above said fixing means.

28. The serial electrophotographic apparatus as claimed in claim 27, wherein a heat radiating member is disposed between said process driving means and said fixing means.

29. The serial electrophotographic apparatus as claimed in claim 28, wherein a heat insulating member is provided above said fixing means.

30. The serial electrophotographic apparatus as claimed in claim 29, wherein heating means for heating said fixing means by induction heating is provided adjacent to a position at which the carriage is located at a start of a printing operation.

31. The serial electrophotographic apparatus as claimed in claim 28, wherein heating means for heating said fixing means by induction heating is provided adjacent to a position at which the carriage is located at a start of a printing operation.

32. The serial electrophotographic apparatus as claimed in claim 27, wherein a heat insulating member is provided above said fixing means.

33. The serial electrophotographic apparatus as claimed in claim 32, wherein heating means for heating said fixing means by induction heating is provided adjacent to a position at which the carriage is located at a start of a printing operation.

34. The serial electrophotographic apparatus as claimed in claim 25, wherein a heat radiating member is disposed between said process driving means and said fixing means.

35. The serial electrophotographic apparatus as claimed in claim 34, wherein a heat insulating member is provided above said fixing means.

36. The serial electrophotographic apparatus as claimed in claim 35, wherein heating means for heating said fixing means by induction heating is provided adjacent to a position at which the carriage is located at a start of a printing operation.

37. The serial electrophotographic apparatus as claimed in claim 34, wherein heating means for heating said fixing means by induction heating is provided adjacent to a position at which the carriage is located at a start of a printing operation.

38. The serial electrophotographic apparatus as claimed in claim 1, wherein said process driving means is provided above said fixing means.

39. The serial electrophotographic apparatus as claimed in claim 38, wherein a heat radiating member is disposed between said process driving means and said fixing means.

40. The serial electrophotographic apparatus as claimed in claim 39, wherein a heat insulating member is provided above said fixing means.

41. The serial electrophotographic apparatus as claimed in claim 40, wherein heating means for heating said fixing means by induction heating is provided adjacent to a position at which the carriage is located at a start of a printing operation.

42. The serial electrophotographic apparatus as claimed in claim 39, wherein heating means for heating said fixing means by induction heating is provided adjacent to a position at which the carriage is located at a start of a printing operation.

43. The serial electrophotographic apparatus as claimed in claim 38, wherein a heat insulating member is provided above said fixing means.

44. The serial electrophotographic apparatus as claimed in claim 43, wherein heating means for heating said fixing means by induction heating is provided adjacent to a position at which the carriage is located at a start of a printing operation.

45. The serial electrophotographic apparatus as claimed in claim 1, wherein heating means for heating said fixing means by induction heating is provided adjacent to a position at which the carriage is located at a start of a printing operation.

46. A serial electrophotographic apparatus as claimed in claim 1, wherein lifting means for lifting said image carrying body and said fixing means away from said recording paper is provided in a sliding part of said carriage.

47. A serial electrophotographic apparatus comprising:

transporting means for transporting recording paper;

process driving means for rotating an image carrying body which has a rotation shaft parallel with a direction in which the recording paper is transported, said process driving means being fitted to a carriage;

processing means which develops a latent image using a charger and an exposer, said exposer being rotatably fitted to the carriage, and said processing means not including the exposer being rotatably and detachably fitted to the carriage;

transferring means which, placed beneath the recording paper, transfers a developed image to the recording paper as the carriage moves;

translating means for translating said carriage above said transferring means in a direction perpendicular to the direction in which the recording paper is transported; and fixing means for fixing the image transferred to the recording paper using a heated fixing member;

wherein said fixing means is rotatably and detachably provided within said carriage.

48. The serial electrophotographic apparatus as claimed in claim 47, wherein there is provided a fixing member by which said processing means not including the exposer is detachably coupled to said process driving means and said exposer.

49. The serial electrophotographic apparatus as claimed in claim 48, wherein said fixing means remains coupled to said process driving means when said process driving means is detached from the processing means not including the exposer, or said fixing means remains coupled to said processing means not including the exposer when said processing means is detached from the process driving means.

50. The serial electrophotographic apparatus as claimed in claim 48, wherein said processing means is provided with a positioning part for positioning said exposer.

51. The serial electrophotographic apparatus as claimed in claim 48, wherein said process driving means is provided above said fixing means.

52. The serial electrophotographic apparatus as claimed in claim 51, wherein a heat radiating member is disposed between said process driving means and said fixing means.

53. The serial electrophotographic apparatus as claimed in claim 52, wherein a heat insulating member is provided above said fixing means.

54. The serial electrophotographic apparatus as claimed in claim 53, wherein heating means for heating said fixing means by induction heating is provided adjacent to a position at which the carriage is located at a start of a printing operation.

55. The serial electrophotographic apparatus as claimed in claim 52, wherein heating means for heating said fixing means by induction heating is provided adjacent to a position at which the carriage is located at a start of a printing operation.

56. The serial electrophotographic apparatus as claimed in claim 51, wherein a heat insulating member is provided above said fixing means.

57. The serial electrophotographic apparatus as claimed in claim 56, wherein heating means for heating said fixing means by induction heating is provided adjacent to a position at which the carriage is located at a start of a printing operation.

58. The serial electrophotographic apparatus as claimed in claim 47, wherein said process driving means is provided above said fixing means.

59. The serial electrophotographic apparatus as claimed in claim 58, wherein a heat radiating member is disposed between said process driving means and said fixing means.

60. The serial electrophotographic apparatus as claimed in claim 59, wherein a heat insulating member is provided above said fixing means.

61. The serial electrophotographic apparatus as claimed in claim 60, wherein heating means for heating said fixing means by induction heating is provided adjacent to a position at which the carriage is located at a start of a printing operation.

62. The serial electrophotographic apparatus as claimed in claim 59, wherein heating means for heating said fixing means by induction heating is provided adjacent to a position at which the carriage is located at a start of a printing operation.

63. The serial electrophotographic apparatus as claimed in claim 58, wherein a heat insulating member is provided above said fixing means.

64. The serial electrophotographic apparatus as claimed in claim 63, wherein heating means for heating said fixing means by induction heating is provided adjacent to a position at which the carriage is located at a start of a printing operation.

65. The serial electrophotographic apparatus as claimed in claim 47, wherein heating means for heating said fixing means by induction heating is provided adjacent to a position at which the carriage is located at a start of a printing operation.

66. A serial electrophotographic apparatus comprising:

transporting means for transporting recording paper;

process driving means for rotating an image carrying body which has a rotation shaft parallel with a direction in which the recording paper is transported, said process driving means being fitted to a carriage;

processing means which develops a latent image using a charger and an exposer, said exposer being rotatably fitted to the carriage, and said processing means not including the exposer being rotatably and detachably fitted to the carriage;

transferring means which, placed beneath the recording paper, transfers a developed image to the recording paper as the carriage moves;

translating means for translating said carriage above said transferring means in a direction perpendicular to the direction in which the recording paper is transported; and fixing means for fixing the image transferred to the recording paper using a heated fixing member;

wherein there is provided a fixing member by which said processing means not including the exposer is detachably coupled to said process driving means and said exposer; and wherein said fixing means remains coupled to said process driving means when said process driving means is detached from the processing means not including the exposer, or said fixing means remains coupled to said processing means not including the exposer when said processing means is detached from the process driving means.

67. A serial electrophotographic apparatus comprising:

transporting means for transporting recording paper;

process driving means for rotating an image carrying body which has a rotation shaft parallel with a direction in which the recording paper is transported, said process driving means being fitted to a carriage;

processing means which develops a latent image using a charger and an exposer, said exposer being rotatably fitted to the carriage, and said processing means not including the exposer being rotatably and detachably fitted to the carriage;

transferring means which, placed beneath the recording paper, transfers a developed image to the recording paper as the carriage moves;

translating means for translating said carriage above said transferring means in a direction perpendicular t the direction in which the recording paper is transported; and fixing means for fixing the image transferred to the recording paper using a heated fixing member;

wherein there is provided a fixing member by which said processing means not including the exposer is detachably coupled to said process driving wherein sand said exposer; and wherein said processing means is provided with a positioning part for positioning said exposer.

68. A serial electrophotographic apparatus comprising:

transporting means for transporting recording paper;

process driving means for rotating an image carrying body which has a rotation shaft parallel with a direction in which the recording paper is transported, said process driving means being fitted to a carriage;

processing means which develops a latent image using a charger and an exposer, said exposer being rotatably fitted to the carriage, and said processing means not including the exposer being rotatably and detachably fitted to the carriage;

transferring means which, placed beneath the recording paper, transfers a developed image to the recording paper as the carriage moves;

translating means for translating said carriage above said transferring means in a direction perpendicular to the direction in which the recording paper is transported; and fixing means for fixing the image transferred to the recording paper using a heated fixing member;

wherein at least one of said process driving means and said exposer is fitted to a heat conductive mounting member.

69. The serial electrophotographic apparatus as claimed in claim 68, wherein said exposer is fitted to said heat conductive mounting member via a heat radiating mounting member.

70. The serial electrophotographic apparatus as claimed in claim 68, wherein said fixing means is fitted to said heat conductive mounting member or a heat insulating mounting member via a heat conductive member.

71. The serial electrophotographic apparatus as claimed in claim 70, wherein said process driving means is provided above said fixing means.

72. The serial electrophotographic apparatus as claimed in claim 71, wherein a heat radiating member is disposed between said process driving means and said fixing means.

73. The serial electrophotographic apparatus as claimed in claim 72, wherein a heat insulating member is provided above said fixing means.

74. The serial electrophotographic apparatus as claimed in claim 73, wherein heating means for heating said fixing means by induction heating is provided adjacent to a position at which the carriage is located at a start of a printing operation.

75. The serial electrophotographic apparatus as claimed in claim 72, wherein heating means for heating said fixing means by induction heating is provided adjacent to a position at which the carriage is located at a start of a printing operation.

76. The serial electrophotographic apparatus as claimed in claim 71, wherein a heat insulating member is provided above said fixing means.

77. The serial electrophotographic apparatus as claimed in claim 76, wherein heating means for heating said fixing means by induction heating is provided adjacent to a position at which the carriage is located at a start of a printing operation.

78. The serial electrophotographic apparatus as claimed in claim 70, wherein a heat radiating member is disposed between said process driving means and said fixing means.

79. The serial electrophotographic apparatus as claimed in claim 78, wherein a heat insulating member is provided above said fixing means.

80. The serial electrophotographic apparatus as claimed in claim 79, wherein heating means for heating said fixing means by induction heating is provided adjacent to a position at which the carriage is located at a start of a printing operation.

81. The serial electrophotographic apparatus as claimed in claim 78, wherein heating means for heating said fixing means by induction heating is provided adjacent to a position at which the carriage is located at a start of a printing operation.

82. A serial electrophotographic apparatus comprising:

transporting means for transporting recording paper;

process driving means for rotating an image carrying body which has a rotation shaft parallel with a direction in which the recording paper is transported, said process driving means being fitted to a carriage;

processing means which develops a latent image using a charger and an exposer, said exposer being rotatably fitted to the carriage, and said processing means not including the exposer being rotatably and detachably fitted to the carriage;

transferring means which, placed beneath the recording paper, transfers a developed image to the recording paper as the carriage moves;

translating means for translating said carriage above said transferring means in a direction perpendicular to the direction in which the recording paper is transported; and fixing means for fixing the image transferred to the recording paper using a heated fixing member;

wherein there is provided a fixing member by which said processing means not including the exposer is detachably coupled to said process driving means and said exposer; and wherein said fixing means remains coupled to said process driving means when said process driving means is detached from the processing means not including the exposer, or said fixing means remains coupled to said processing means not including the exposer when said processing means is detached from the process driving means.

83. The serial electrophotographic apparatus as claimed in claim 82, wherein a heat insulating member is provided above said fixing means.

84. The serial electrophotographic apparatus as claimed in claim 83, wherein heating means for heating said fixing means by induction heating is provided adjacent to a position at which the carriage is located at a start of a printing operation.

85. The serial electrophotographic apparatus as claimed in claim 82, wherein a heat radiating member is disposed between said process driving means and said fixing means.

86. The serial electrophotographic apparatus as claimed in claim 85, wherein a heat insulating member is provided above said fixing means.

87. The serial electrophotographic apparatus as claimed in claim 86, wherein heating means for heating said fixing means by induction heating is provided adjacent to a position at which the carriage is located at a start of a printing operation.

88. The serial electrophotographic apparatus as claimed in claim 85, wherein heating means for heating said fixing means by induction heating is provided adjacent to a position at which the carriage is located at a start of a printing operation.

89. A serial electrophotographic apparatus comprising:

transporting means for transporting recording paper;

process driving means for rotating an image carrying body which has a rotation shaft parallel with a direction in which the recording paper is transported, said process driving means being fitted to a carriage;

processing means which develops a latent image using a charger and an exposer, said exposer being rotatably fitted to the carriage, and said processing means not including the exposer being rotatably and detachably fitted to the carriage;

transferring means which, placed beneath the recording paper, transfers a developed image to the recording paper as the carriage moves;

translating means for translating said carriage above said transferring means in a direction perpendicular to the direction in which the recording paper is transported; and fixing means for fixing the image transferred to the recording paper using a heated fixing member;

wherein said process driving means is provided above said fixing means; and wherein a heat radiating member is disposed between said process driving means and said fixing means.

90. The serial electrophotographic apparatus as claimed in claim 89, wherein a heat insulating member is provided above said fixing means.

91. The serial electrophotographic apparatus as claimed in claim 90, wherein heating means for heating said fixing means by induction heating is provided adjacent to a position at which the carriage is located at a start of a printing operation.

92. The serial electrophotographic apparatus as claimed in claim 89, wherein heating means for heating said fixing means by induction heating is provided adjacent to a position at which the carriage is located at a start of a printing operation.

93. A serial electrophotographic apparatus comprising:

transporting means for transporting recording paper;

process driving means for rotating an image carrying body which has a rotation shaft parallel with a direction in which the recording paper is transported, said process driving means being fitted to a carriage;

processing means which develops a latent image using a charger and an exposer, said exposer being rotatably fitted to the carriage, and said processing means not including the exposer being rotatably and detachably fitted to the carriage;

transferring means which, placed beneath the recording paper, transfers a developed image to the recording paper as the carriage moves;

translating means for translating said carriage above said transferring means in a direction perpendicular to the direction in which the recording paper is transported; and fixing means for fixing the image transferred to the recording paper using a heated fixing member;

wherein said process driving means is provided above said fixing means; and wherein a heat insulating member is provided above said fixing means.

94. The serial electrophotographic apparatus as claimed in claim 93, wherein heating means for heating said fixing means by induction heating is provided adjacent to a position at which the carriage is located at a start of a printing operation.

95. A serial electrophotographic apparatus comprising:

transporting means for transporting recording paper;

process driving means for rotating an image carrying body which has a rotation shaft parallel with a direction in which the recording paper is transported, said process driving means being fitted to a carriage;

processing means which develops a latent image using a charger and an exposer, said exposer being rotatably fitted to the carriage, and said processing means not including the exposer being rotatably and detachably fitted to the carriage;

transferring means which, placed beneath the recording paper, transfers a developed image to the recording paper as the carriage moves;

translating means for translating said carriage above said transferring means in a direction perpendicular to the direction in which the recording paper is transported; and fixing means for fixing the image transferred to the recording paper using a heated fixing member;

wherein lifting means for lifting said image carrying body and said fixing means away from said recording paper is provided in a sliding part of said carriage.

* * * * *